US007338156B2

(12) United States Patent
Janssen et al.

(10) Patent No.: US 7,338,156 B2
(45) Date of Patent: Mar. 4, 2008

(54) ALIGNMENT OF RECORDING MATERIAL IN A PRINTING DEVICE

(75) Inventors: Paul Janssen, Retie (BE); Francois Joos, Puurs (BE); Luc Van Goethem, St. Gillis Waas (BE)

(73) Assignee: Agfa HealthCare, Mortsel (BE)

( * ) Notice: Subject to any disclaimer, the term of this patent is extended or adjusted under 35 U.S.C. 154(b) by 0 days.

(21) Appl. No.: 10/988,098

(22) Filed: Nov. 12, 2004

(65) Prior Publication Data

US 2005/0110858 A1 May 26, 2005

Related U.S. Application Data

(60) Provisional application No. 60/526,113, filed on Dec. 1, 2003.

(30) Foreign Application Priority Data

Nov. 24, 2003 (EP) ..... 03104335

(51) Int. Cl.
*B41J 2/01* (2006.01)

(52) U.S. Cl. ..... 347/104; 347/101

(58) Field of Classification Search ..... 347/104, 347/101; 400/630, 631, 579, 271, 234, 235, 400/236

See application file for complete search history.

(56) References Cited

U.S. PATENT DOCUMENTS 4,543,003 A 9/1985 Andersson
4,700,200 A * 10/1987 Hibino ..... 347/179
4,898,375 A 2/1990 Holtje
5,304,008 A * 4/1994 Asakura et al. ..... 400/234
5,974,283 A * 10/1999 Cho ..... 399/75
6,079,887 A 6/2000 Koyabu et al.

FOREIGN PATENT DOCUMENTS

DE 39 02 199 A1 8/1990
DE 19612544 A1 * 10/1997
EP 1 033 256 A2 9/2000

OTHER PUBLICATIONS

Search Report for EP 03 10 4335 (Feb. 17, 2004).

* cited by examiner

*Primary Examiner*—Manish S. Shah
(74) *Attorney, Agent, or Firm*—Leydig, Voit & Mayer, Ltd.

(57) ABSTRACT

A sheet of recording material is fed along a sheet guide defining an at least partially curved transport path until a leading edge of the sheet contacts a first of at least two alignment pins defining an alignment line and sheet feeding is continued until the leading edge contacts a second alignment pin whereby the distance of the transport path of the sheet is allowed to change and the entirety of each sheet of recording material does not contact the sheet guide during feeding of said sheet.

12 Claims, 3 Drawing Sheets

ALIGNMENT OF RECORDING MATERIAL IN A PRINTING DEVICE

The application claims the benefit of U.S. Provisional Application No. 60/526,113 filed Dec. 1, 2003.

FIELD OF THE INVENTION

The present invention relates to a method and apparatus for aligning a sheet of recording material in a recording device, more particularly a direct thermal printer.

BACKGROUND OF THE INVENTION

In direct thermal printing a visible image pattern is produced by image-wise heating of a recording material comprising chemical components that change colour or density by a physical or chemical process when the material is heated. A particular interesting direct thermal imaging element comprises an organic silver salt in combination with a reducing agent. When being heated, the silver ions are developed to metallic silver.

Image-wise heating can be obtained by means of a thermal printing head comprising an array of juxtaposed heating elements, e.g. resistors.

Most commonly line-wise recording heads are used. In this case the recording head comprises at least one linear array of heating elements, e.g. one resistor per pixel in a line. The thermal head writes one line at the time. A two-dimensional image is obtained by printing a number of parallel lines by transporting the thermal head and the recording material relative to each other in the so-called sub-scan direction, i.e. in a direction perpendicular to the line-wise printing direction of the thermal head.

The heating of the elements of the thermal head is controlled by an electric signal representation of the image. The density value of each pixel is represented by means of an N-bit digital signal value. Since the elements of a thermal recording head commonly are binary controllable devices, a time-multiplexing technique is applied for feeding an N-bit signal value to an element of the thermal head.

When printing an image, it is desired that a line printed by means of a linear array of heating elements is parallel with the edge of the recording material. To obtain this goal, the recording material which is transported in the printer is subjected to an alignment procedure prior to image recording.

Several alignment methods are known in the art.

In one prior art technique a sheet of recording material is completely taken out of a supply tray and is subjected to an alignment procedure before reaching the printing head. For example for aligning the sheet in a first direction use is made of gravity. The sheet which is first guided into a substantially vertical position is dropped onto a horizontal reference platen.

Alignment in a second direction perpendicular to the first direction is performed by means of a set of alignment stops. After alignment the sheet is transported towards the recording head. Since the sheet is entirely out of the supply tray during the alignment procedure the apparatus cannot be made very compact.

In an alternative alignment procedure the sheet of recording material is fed towards two (or more) pairs of touching rollers whereby the points of contact of the roller pairs define an alignment line. Once the sheet reaches the contact points between the pairs of rollers, the rollers are activated and the sheet is transported towards the recording head. The pairs of rollers are commonly positioned behind the recording head in the direction of transport. As a consequence a large border of recording material cannot be used for printing.

This may be avoided by reversing the transport direction after alignment. However, this solution might soil the recording material and thus might decrease the accuracy of the printing process.

SUMMARY OF THE INVENTION

The present invention provides an alignment method for a sheet material as set out in claim 1.

Another aspect of the invention relates to an alignment device and to a printer, more specifically a thermal printer, incorporating is such an alignment device.

Specific features for preferred embodiments of the invention are set out in the dependent claims.

According to the present invention the distance of the transport path of the recording sheet is allowed to change. In one embodiment of the present invention the sheet guide allows the curvature of the transport path to change.

The sheet guide may for example be an at least partially curved platen guiding the recording material when it is fed from the supply tray towards the recording head. Alternative embodiments are possible such as a guiding means that consists of different parts which together define an at least partially curved transport path. Suitable alternatives are a number of axes or a system of rollers arranged as guiding means etc.

A flat transport path is likewise possible within the context of the present invention as long as distance of the transport path is allowed to change.

However, a tight sleeve through which a sheet should pass would not provide the necessary flexibility and would hence not fulfill the requirements of the present invention.

In accordance with the present invention the sheet is continuously driven during the alignment procedure. In a specific embodiment wherein the sheet is driven out of a supply tray by means of a means situated at the supply tray's height, the distance of the transport path is smaller than the length of the sheet.

In the context of the present invention various embodiments of alignment means may be envisaged.

In a first embodiment the alignment means comprise at least two alignment pins that can be placed in or out the transport path of the recording material. The alignment pins define an alignment line which is preferably positioned parallel to a linear array of thermal elements in the recording head. When the leading edge of the recording material is aligned relative to the alignment pins, a printed line will be parallel to that leading edge.

In another embodiment the alignment means is a strip of material against which the recording material is aligned.

Still other alternatives are possible.

Preferably the alignment means is positioned close to but behind the recording head when viewed in the direction of transport of the sheet.

Further advantages and embodiments of the present invention will become apparent from the following description and drawings.

The invention is described with reference to a thermal printer. It is clear that this invention is also applicable to other types of recording devices and to other devices in general in which sheet materials are to be aligned against a reference alignment line.

DETAILED DESCRIPTION OF THE INVENTION

Figure 1:
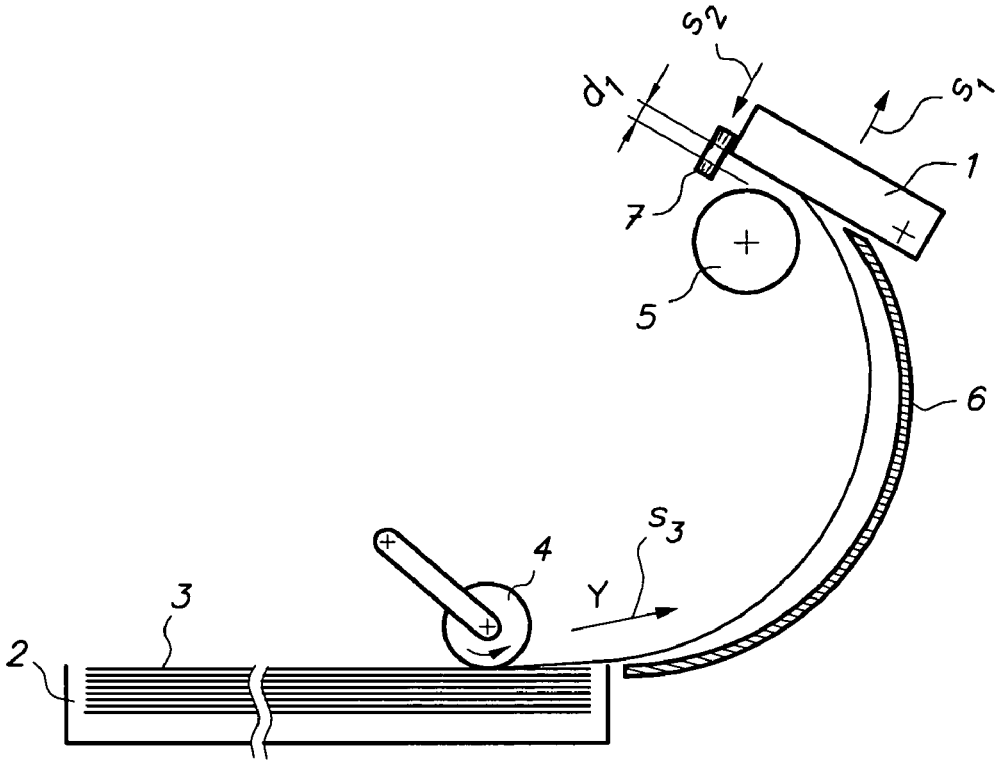
FIGS. 1, 3, and 5 show the components of the printer that are relevant with regard to the present invention. These figures illustrate different steps of the transport and alignment of a recording sheet in a printing device.

The invention is illustrated with reference to a direct thermal printer comprising a print head indicated by numeral 1. Print head has at least one linear array of juxtaposed resistor elements 10 forming a line which is perpendicular to the plane of the drawing. The print head also comprises associated electronic driver circuitry (not shown).

The printer further comprises a supply tray 2 comprising a stock of recording material 3 and pick up means 4, e.g. a driven roller which is in contact with the upper sheet in the tray and serves to take a sheet of recording material from the tray and feed it into an envisaged transport direction towards the thermal head.

During image recording the sheet of recording material is transported in between thermal head 1 and a driven rotatable drum 5 so that the recording material is advanced past the recording head.

The thermal head and rotatable drum can be brought in and out of contact, e.g. by lifting or lowering the thermal head relative to the rotatable drum.

The printer further comprises a guiding means 6 for guiding the recording material towards the position of the recording head.

In the illustrated embodiment the guiding means is in the form of a curved platen.

When being contacted by the recording material, the curved platen provides that the material while being supplied from the supply tray, is curved and guided towards the recording head. At the same time the guiding means provides that the curvature of the transport path is allowed to change once the recording material bumps into some kind of barrier in its path of transportation such as an alignment pin, as will be explained further on.

The apparatus further comprises a number of alignment means indicated by numeral 7 defining an alignment line against which the recording material is aligned.

In one embodiment two alignment pins 7*a* and 7*b* are provided which define an alignment line. The alignment line is preferably parallel to a linear array of heat sensitive elements in the recording head providing that if the leading edge of the recording material is aligned relative to the line defined by the alignment pins, a line printed by this array of heat sensitive elements will be parallel with the leading edge of the recording material.

The alignment pins are preferably positioned behind the thermal head when viewed in the direction of transport of the recording material. The alignment pins can be lifted or lowered so that they are either positioned in or out of the transport path of the recording material.

Although the invention has been described with reference to an embodiment comprising a single supply tray, it will be clear that it is also applicable to embodiments with more than one supply tray in which a sheet may exit a supply tray under another angle than shown in the figure and wherein (an)other pick up system(s) may be provided.

The procedure of aligning a sheet of recording material is as follows. Successive procedural steps are indicated throughout the drawings as steps $s_i$.

Step 1:

First the thermal head is lifted ($s_1$) so that a gap is created in between the thermal head and the rotatable drum. A sheet of recording material can easily be transported in between the thermal head and the rotatable drum while the drum is not rotating and the printing process is not activated.

Step 2:

Next, the alignment pins are lowered ($S_2$) so that they are brought into the transport path of the recording sheet and so that they close the gap with width $d_1$ between the lower side of the thermal head and rotatable drum.

Step 3:

A sheet of recording material is fed from the supply tray ($S_3$) in the direction indicated by 'y'. In this embodiment the sheet is pushed out of the tray by means of a driven feeding roller 3 which is put into contact with the upper sheet in the tray.

When the recording material is pushed out of the tray, its leading edge bumps onto the guiding means 3 which will cause the material to bend. The recording material substantially follows the curved path defined by the curved guiding means 3 until its leading edge reaches the recording head. At that location the recording material will be guided into the direction of the alignment pins 7*a* and 7*b*.

Figure 2:
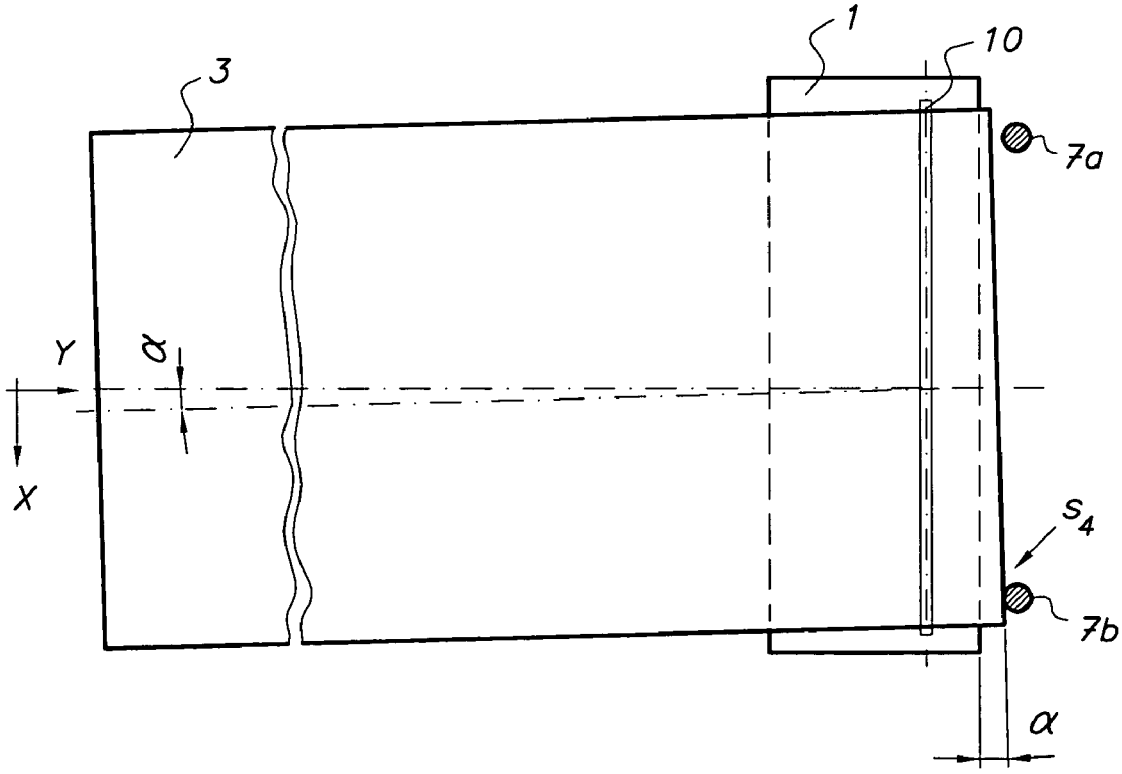
FIGS. 2, 4 and 6 illustrate the position of a sheet of recording material relative to two alignment stops during different steps of the alignment procedure according to the present invention.

Step 4:

If the sheet is not properly aligned with the alignment line defined by the alignment pins, the leading edge of the sheet will first abut ($s_4$) a first of the reference pins as is shown in FIG. 2. At this point there is an offset from the direction of the alignment line defined by the alignment pins, which line is preferably parallel to the linear array of thermal elements 10. This offset is indicated by the angle $\alpha$.

Figure 3:
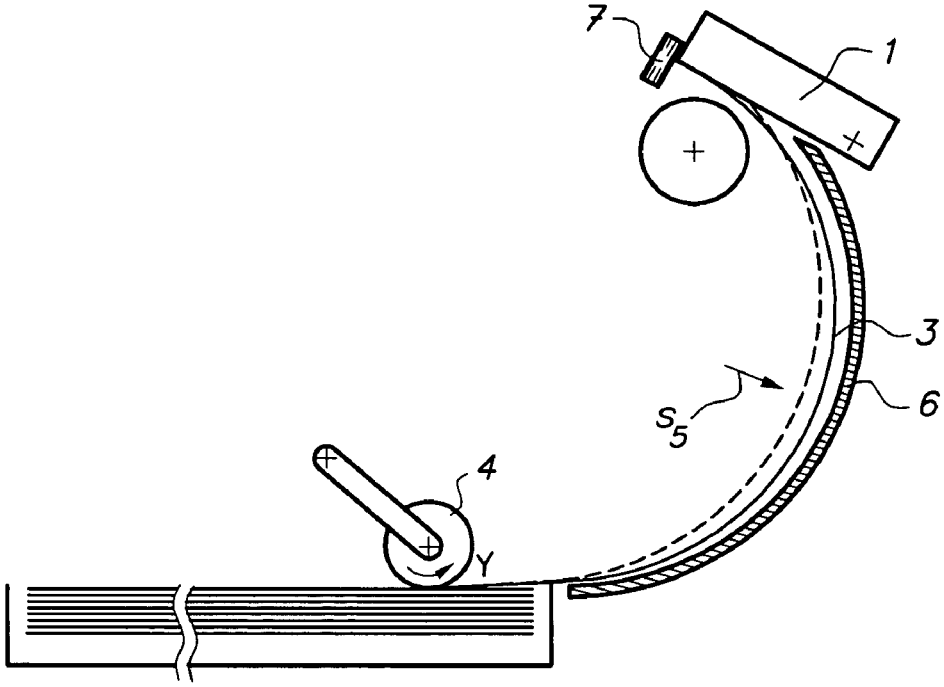
Figure 4:
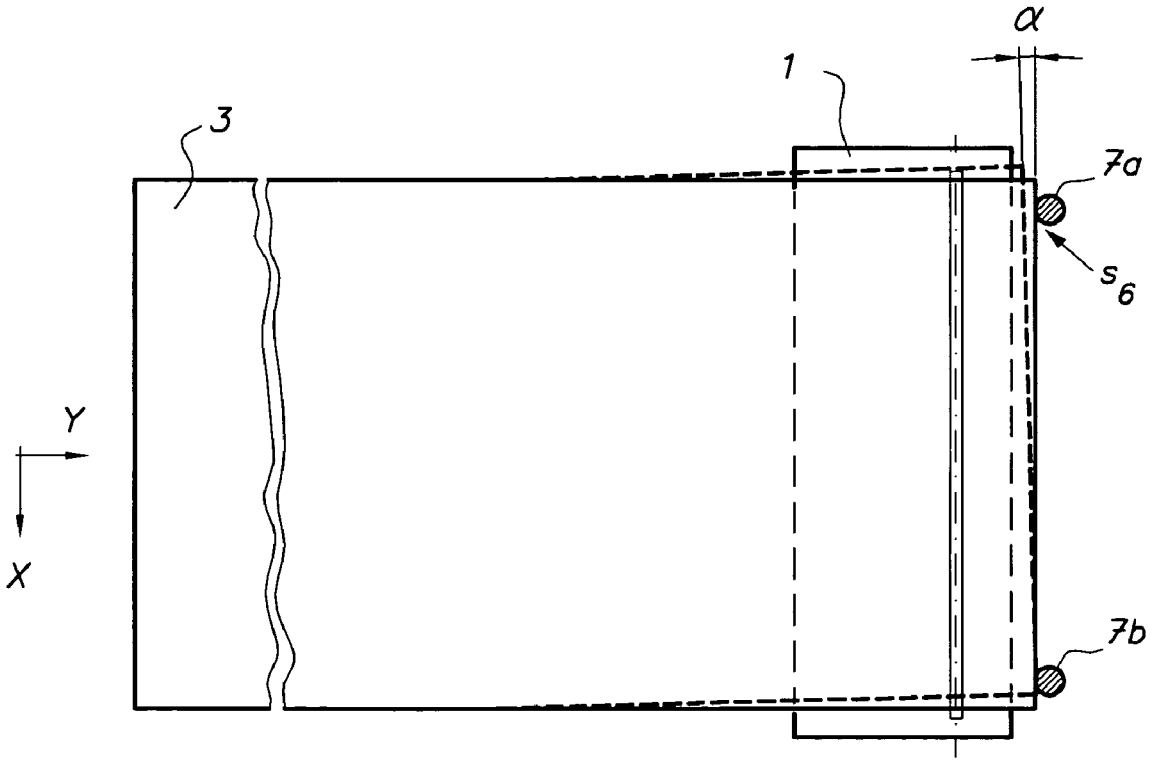
Figure 5:
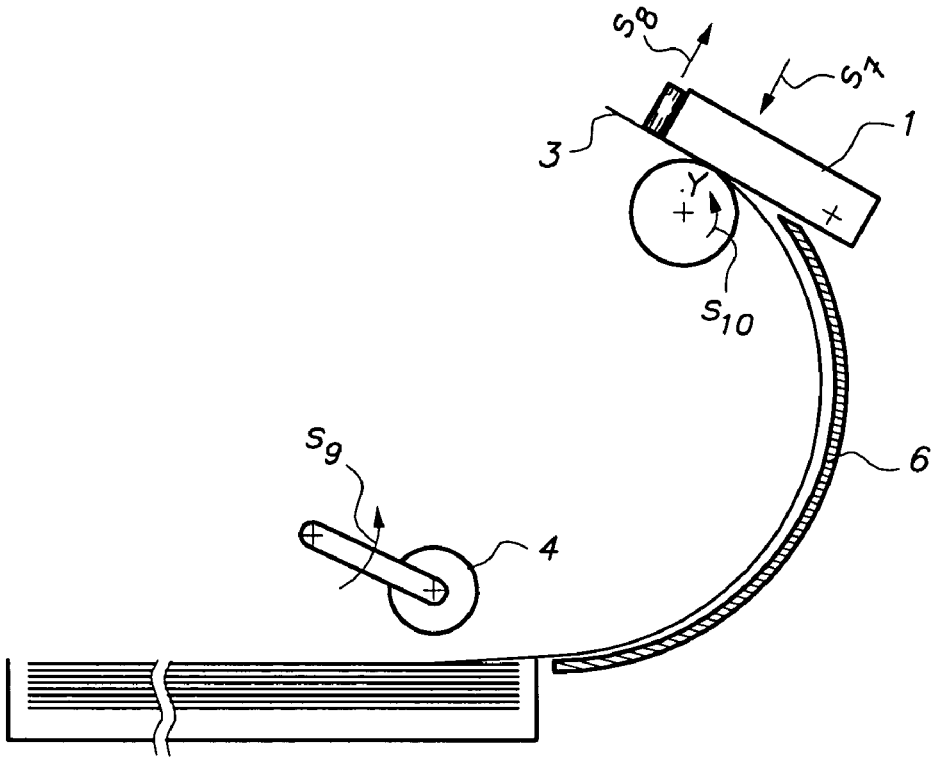
Figure 6:
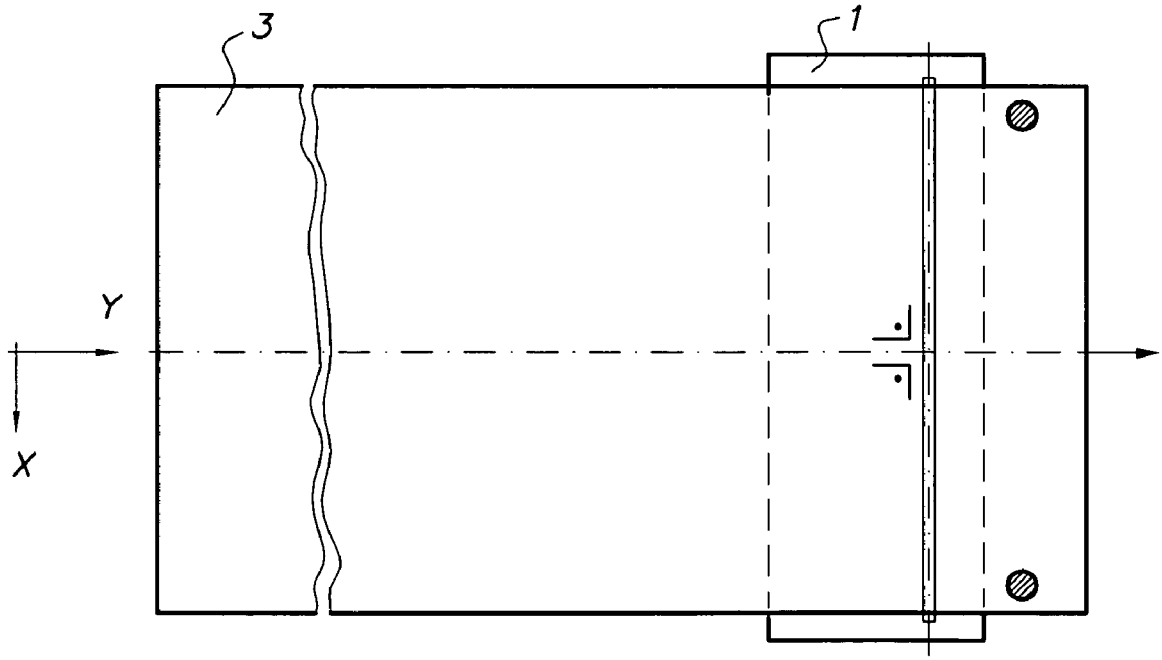

Steps 5 and 6:

Since the sheet is still continuously pushed from the tray and because the guiding means allows the curvature of the transport path of the sheet to change ($s_5$), the sheet will continue to move until its leading edge also contacts the second of the guiding pins ($S_6$) so that it is aligned with the line defined by the two guiding pins as is illustrated in FIGS. 3 and 4.

Step 7:

Finally, when the sheet is aligned, the thermal head is lowered ($S_7$) so that it contacts the sheet and the rotatable drum. Next the alignment pins are lifted ($s_8$) so that they are out of the transport path and also the feeding roller is lifted ($s_9$). Printing can be initiated. From this point on the sheet is transported past the thermal head by activation of the rotatable drum ($s_{10}$).

The invention claimed is:

1. A method of aligning a sheet of recording material in a recording device comprising:

(a) feeding said sheet of recording material along a sheet guide defining an at least partially curved transport path until a leading edge of said sheet of recording material makes a first contact with an alignment means defining an alignment line, and (b) continuing said feeding until said leading edge makes a second contact with said alignment means, wherein the curvature of said sheet of recording material is allowed to change during steps (a) and (b), and wherein the entirety of each sheet of recording material does not contact the sheet guide during feeding of said sheet.

2. The method according to claim 1, wherein said alignment means comprises at least two alignment pins defining an alignment line, and wherein said first contact is made with a first alignment pin and said second contact is made with a second alignment pin.

3. The method according to claim 1, wherein the distance of the transport path is less than the length of the recording sheet.

4. A sheet aligning device comprising:

an alignment means defining an alignment line, a sheet guiding means defining an at least partially curved transport path, and means for feeding a sheet of material along said sheet guiding means until a leading edge of said sheet make contact with said alignment means at at least two contact points, wherein the sheet guiding means provides that the curvature of the sheet during the feeding of the sheet until the sheet contacts the at least two contact points is allowed to change relative to the curvature of the transport path, and wherein the entirety of each sheet of recording material does not contact the sheet guide during feeding of said sheet.

5. The sheet aligning device according to claim 4, wherein said alignment means comprises at least two alignment pins, and wherein the means for feeding the sheet continues to feed the sheet until the sheet contacts said at least two contact points.

6. A printer comprising a sheet aligning device according to claim 5.

7. A thermal printer comprising a sheet aligning device according to claim 5.

8. A printer comprising a sheet aligning device according to claim 4.

9. A thermal printer comprising a sheet aligning device according to claim 4.

10. The sheet aligning device according to claim 4, further comprising a supply tray in which a plurality of sheets of recording material resides.

11. The sheet aligning device according to claim 10, wherein at least a portion of the sheet remains in the supply tray during steps (a) and (b).

12. The sheet alignment device according to claim 4, wherein the distance of the transport path is less than the length of the sheet.

* * * * *